US007677706B2

(12) United States Patent
Radominski et al.

(10) Patent No.: US 7,677,706 B2
(45) Date of Patent: Mar. 16, 2010

(54) ELECTROSTATIC ACTUATOR AND FABRICATION METHOD

(75) Inventors: George Z. Radominski, Corvallis, OR (US); Chris Aschoff, Corvallis, OR (US); Alexander Govyadinov, Corvallis, OR (US); Silam J. Choy, Corvallis, OR (US); Martha A. Truninger, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 256 days.

(21) Appl. No.: 11/839,954

(22) Filed: Aug. 16, 2007

(65) Prior Publication Data

US 2009/0046130 A1 Feb. 19, 2009

(51) Int. Cl.
*B41J 2/045* (2006.01)

(52) U.S. Cl. ..... 347/68

(58) Field of Classification Search ..... 347/68, 347/69–72, 62, 63, 54, 55, 46; 400/124.14–124.17, 400/124.23; 310/323.06, 323.08, 324, 330, 310/331; 29/25.35

See application file for complete search history.

(56) References Cited

U.S. PATENT DOCUMENTS 6,168,263 B1 1/2001 Nojima et al.
6,331,258 B1 12/2001 Silverbrook
6,341,847 B1 1/2002 Ohta et al.
6,830,701 B2 12/2004 Debar et al.
6,863,382 B2 3/2005 Anagnostopoulos et al.
6,964,469 B2 * 11/2005 Sanada ..... 347/46
7,042,137 B2 5/2006 Yoon
7,108,354 B2 9/2006 Gulvin
7,185,972 B2 3/2007 Tanikawa
7,334,871 B2 * 2/2008 Radominski et al. ..... 347/46
2005/0212868 A1 9/2005 Radominski et al.
2005/0264617 A1 12/2005 Nishimura et al.

OTHER PUBLICATIONS

International Search Report for Application No. PCT/US2008/072142. Report issued Dec. 18, 2008.

* cited by examiner

*Primary Examiner*—K. Feggins

(57) ABSTRACT

In one embodiment a method of making an electrostatic actuator includes: forming a first conductor over a first substrate to form a first structure; forming a flexible second conductor over a second substrate to form a second structure; forming an etch stop over the first conductor as part of the first structure or over the second conductor as part of the second structure; forming a spacer on the etch stop, the spacer selectively etchable with respect to the etch stop; etching the spacer through to the etch stop at a location of a gap between the first conductor and the second conductor; and bonding the first structure and the second structure together such that the first conductor is located opposite the second conductor across the gap.

16 Claims, 16 Drawing Sheets

ELECTROSTATIC ACTUATOR AND FABRICATION METHOD

BACKGROUND

The claimed subject matter relates to an electrostatic actuator that may be used in inkjet printing. In conventional methods for fabricating electrostatic actuated inkjet printheads etching is often used to control important dimensions, including the thickness of the conductive membrane and the width of the electrostatic gap between the control conductor and the conductive membrane. Conventional methods also require silicon substrates to support the use of dopant implants and other semiconductor processing materials.

DRAWINGS

FIG. 1 is a block diagram illustrating one embodiment an inkjet printer.

FIGS. 2A and 2B are simplified section views illustrating the operative components of one embodiment of an electrostatic printhead. FIG. 2A shows the actuator in a flexed position in which the ink channel is expanded. FIG. 2B shows the actuator in an unflexed position in which the ink channel is contracted.

FIGS. 5A-16A are crosswise section views, and FIGS. 5B-16B are lengthwise section views, illustrating one embodiment of a process for fabricating an electrostatic printhead such as the one shown in FIGS. 3 and 4.

DESCRIPTION

Embodiments of the present disclosure were developed in an effort to improve methods for fabricating electrostatic inkjet printheads. Embodiments omit processes and materials that require a silicon substrate and eliminate etching to control the width of the electrostatic gap. Embodiments of the disclosure, described with reference to inkjet printing, are not limited to inkjet printing. Other forms, details, and embodiments may be made and implemented. Hence, the following description should not be construed to limit the scope of the disclosure, which is defined in the claims that follow the description.

Figure 1:
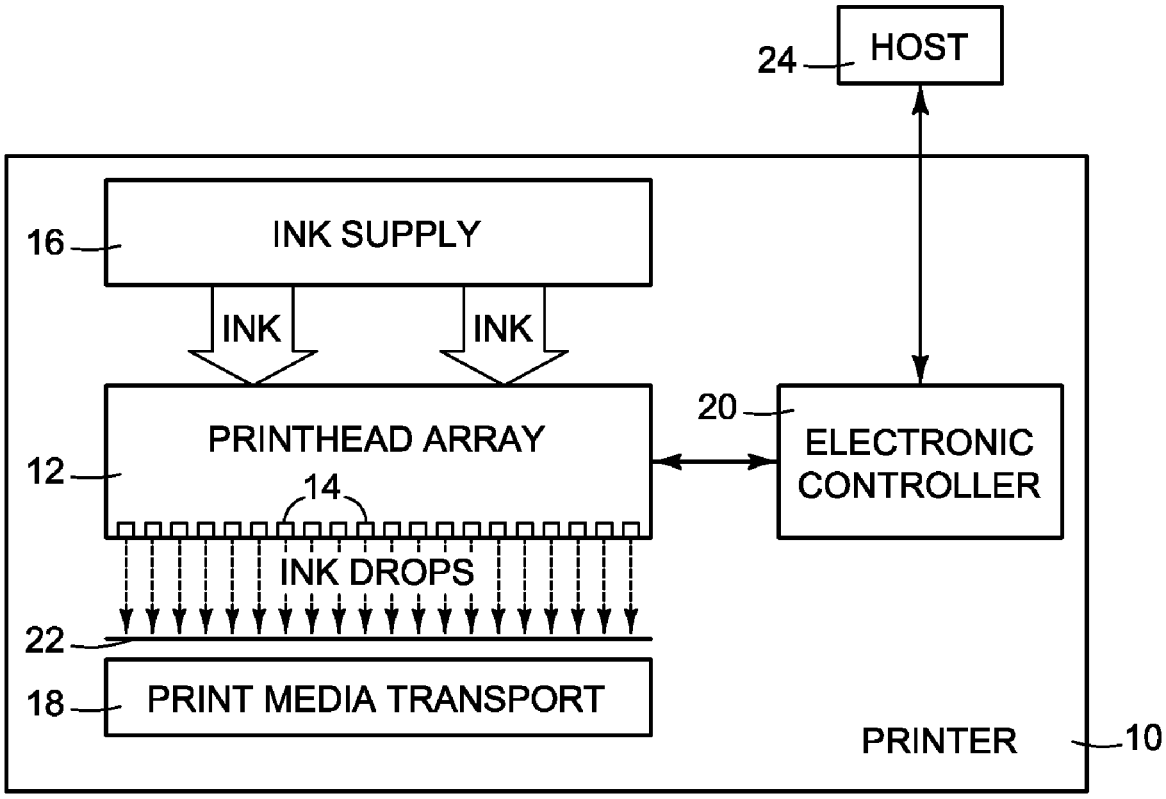

FIG. 1 is a block diagram illustrating an inkjet printer 10 that includes an array 12 of printheads 14, an ink supply 16, a print media transport mechanism 18 and an electronic printer controller 20. Printhead array 12 in FIG. 1 represents generally multiple printheads 14 and the associated mechanical and electrical components for ejecting drops of ink on to a sheet or strip of print media 22. An electrostatic inkjet printhead 14 may include one of more ink ejection orifices each associated with a corresponding ink channel. Electrostatic forces generated by conductors in the printhead flex one wall of the ink channel back and forth rapidly to alternately expand and contract the ink channel to eject drops of ink through the corresponding orifice. (Ink ejection orifices are also commonly referred to as ink ejection nozzles.) In operation, printer controller 20 selectively energizes the conductors in a printhead, or group of printheads, in the appropriate sequence to eject ink on to media 22 in a pattern corresponding to the desired printed image.

Printhead array 12 and ink supply 16 may be housed together as a single unit or they may comprise separate units. Printhead array 12 may be a stationary larger unit (with or without supply 16) spanning the width of print media 22. Alternatively, printhead array 12 may be a smaller unit that is scanned back and forth across the width of media 22 on a moveable carriage. Media transport 18 advances print media 22 lengthwise past printhead array 12. For a stationary printhead array 12, media transport 18 may advance media 22 continuously past the array 12. For a scanning printhead array 12, media transport 18 may advance media 22 incrementally past the array 12, stopping as each swath is printed and then advancing media 22 for printing the next swath. Controller 20 may receive print data from a computer or other host device 24 and, when necessary, process that data into printer control information and image data. Controller 20 controls the movement of the carriage, if any, and media transport 18. As noted above, controller 20 is electrically connected to printhead array 12 to energize the conductors to eject ink drops on to media 22. By coordinating the relative position of array 12 and media 22 with the ejection of ink drops, controller 20 produces the desired image on media 22 according to the print data received from host device 24.

Figure 2A:
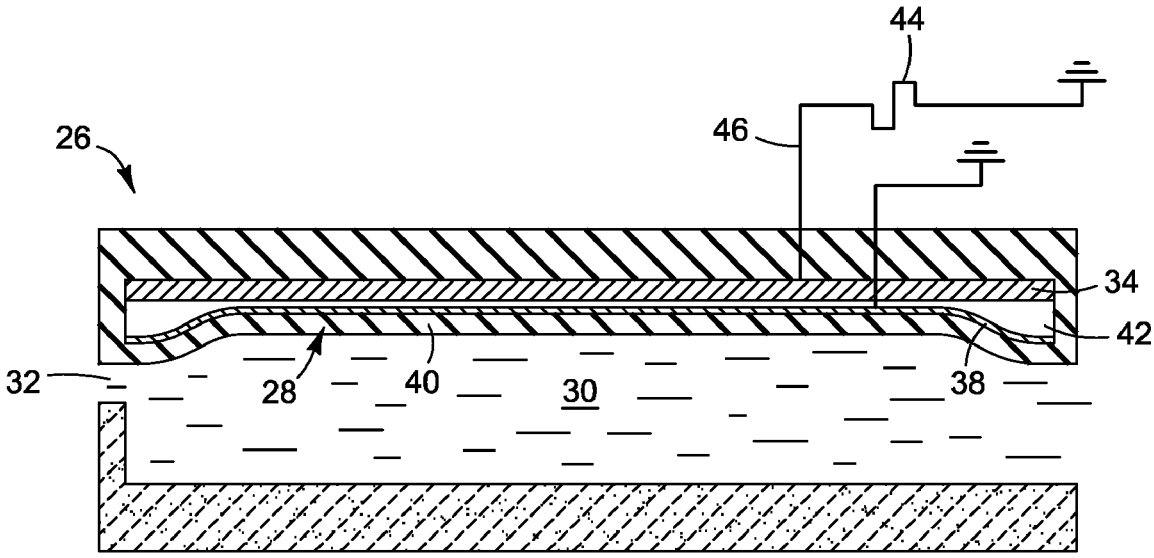
Figure 2B:
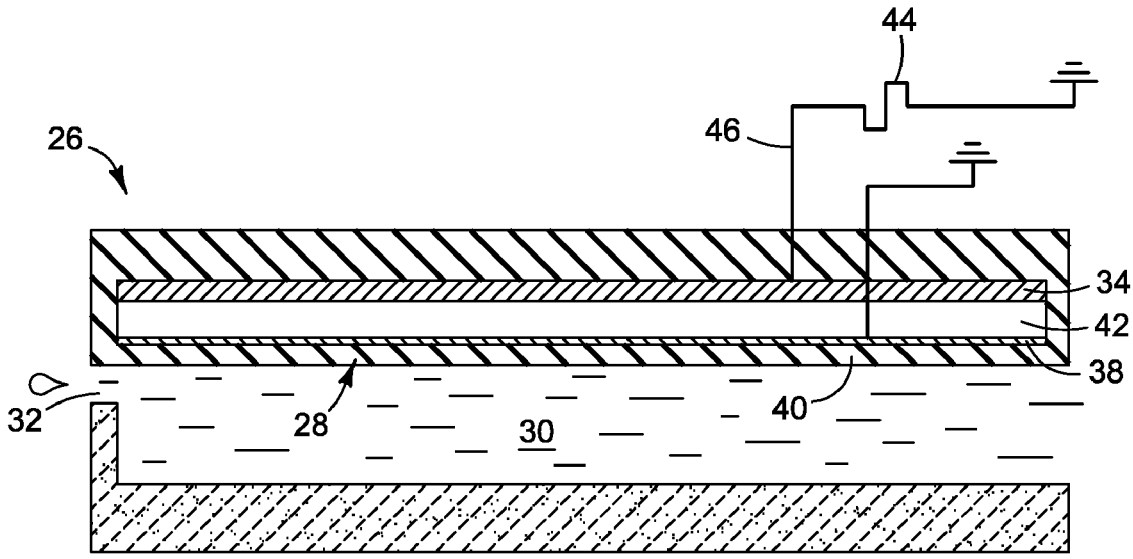

FIGS. 2A and 2B are simplified section views illustrating the operative components of an electrostatic printhead 26 such as might be used as a printhead 14 in array 12 of the printer 10 shown in FIG. 1. The printhead array in a large format inkjet printer, for example, may contain hundreds or thousands of individual printheads 26. FIG. 2A shows an electrostatic actuator 28 in a flexed position in which an ink ejection chamber 30 is expanded. FIG. 2B shows actuator 28 in a flexed position in which ink ejection chamber 30 is contracted to eject an ink drop. Actuator 28 includes a MEMS (micro-electromechanical system) capacitor in which one conductor of the capacitor is attached to the flexible membrane/wall of ink channel 30 and the other/opposite conductor is attached to or part of a rigid substrate. A varying voltage signal applied across the conductors alternately pulls the membrane toward the conductor substrate and releases the membrane to flex back into the original position to pump ink out through an orifice 32.

Referring to FIGS. 2A and 2B, actuator 28 includes a first, non-flexing conductor 34 along actuator substrate 36 and a second, flexing conductor 38 operatively connected to a flexible wall 40 of ink channel ejection chamber 30. Flexible wall 40 is sometimes referred to as a membrane or a vibration plate. Conductor 38 "operatively connected" to wall 40 means that conductor 38 is affixed to or otherwise constrained so that a deformation in conductor 38 creates a corresponding deformation in wall 40. Conductors 34 and 38 extend along ink channel ejection chamber 30 opposite one another across a capacitative/electrostatic gap 42. Non-flexing conductor 34 may itself be flexible or inflexible. If conductor 34 is flexible, then it will be affixed to substrate 36 or another suitable support to achieve the desired rigidity. The extent of flexible wall 40 and/or the extent to which conductor 38 covers wall 40 may vary depending on other characteristics of chamber 30. However, it is expected that flexible wall 40 will usually extend substantially the full length and span substantially the full width of ejection chamber 30, and conductor 38 will usually cover substantially all of the flexible portion of wall 40.

"Control" conductor 34 is connected to a signal generator or other suitable voltage source 44 as indicated by signal line 46. Conductor 38 is held at a ground voltage. Generating a voltage difference between the two conductors 34 and 38 across gap 42 creates electrostatic forces that can be used to flex conductor 38, and correspondingly wall 40, back and forth to alternately expand and contract ejection chamber 30. Varying the magnitude of the voltage difference or modulating the frequency of the control signal in a desired pattern controls the ejection of ink drops through orifice 32. Any suitable drive circuitry and control system may be used to create the desired forces. The drive circuitry shown is just one example configuration. Other configurations are possible. For example, varying voltages could be applied to each conductor 34 and 38 through a separate signal generator connected to each conductor 34, 38. Hence, conductors "operatively connected" to a voltage source as used in this document means connected in such a way that a voltage difference may be generated between the conductors, specifically including but not limited to the connections described above.

Figure 3:
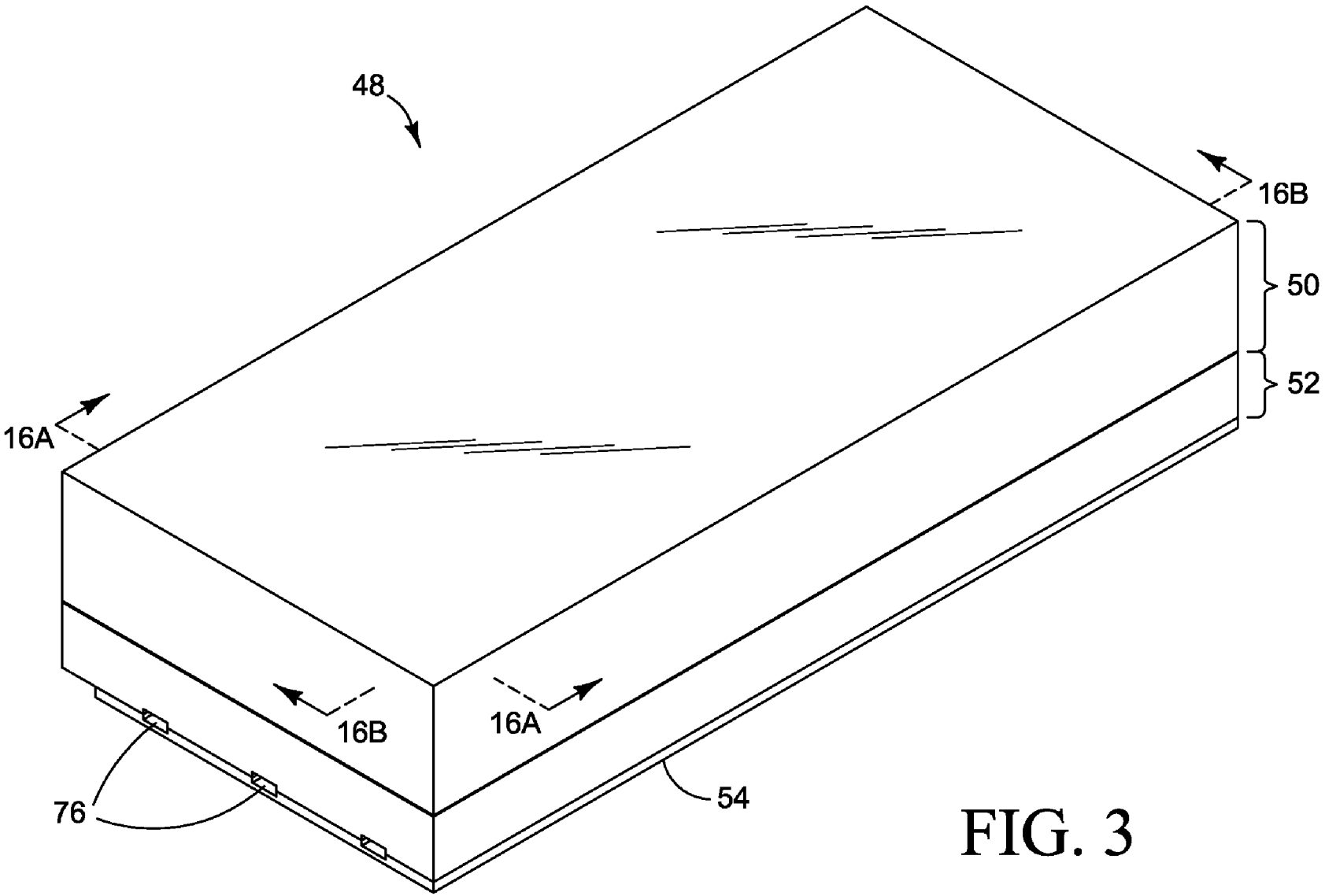
FIG. 3 is a perspective view of an electrostatic printhead constructed according to one embodiment of the present disclosure
Figure 4:
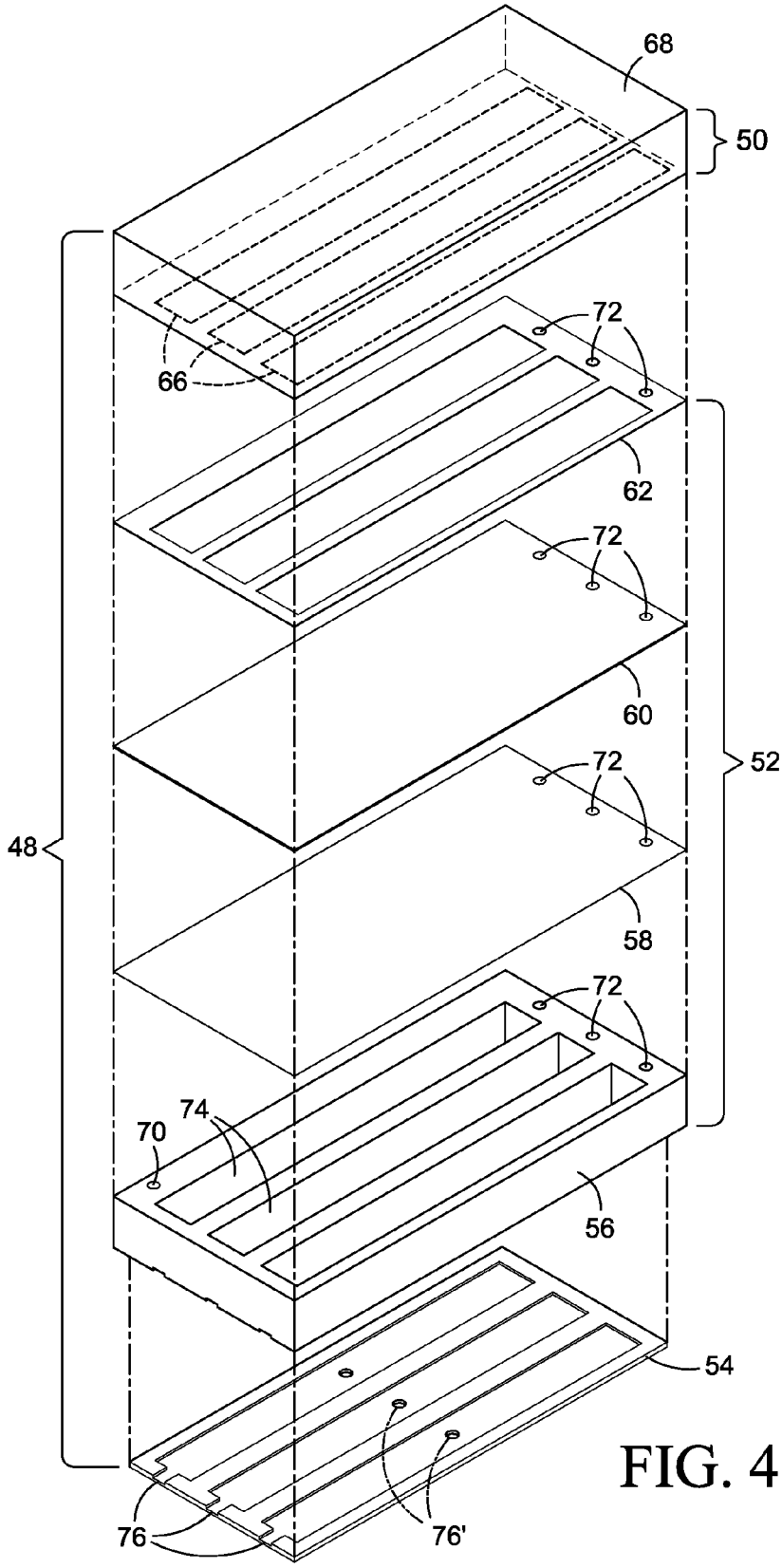
FIG. 4 is an exploded perspective view of the printhead embodiment shown in FIG. 3.

FIGS. 3 and 4 are perspective and exploded perspective views, respectively, of an electrostatic printhead 48 constructed according to one embodiment of the disclosure. Referring to FIGS. 3 and 4, printhead 48 is an assembly composed of a conductor structure 50 affixed to one side of a membrane/ink channel structure 52 and an orifice plate 54 affixed to the other side of the membrane structure 52. Conductor structure 50, membrane structure 52 and orifice plate 54 are fabricated separately and then bonded together or otherwise affixed to one another to form printhead 48. Membrane structure 52 is itself a composite structure that includes four primary components—an ink manifold 56, a "passive" conductor sheet 58, a membrane 60 and a capacitative gap spacer 62.

Conductor structure 50 is also a composite structure that includes "control" conductors 66 formed on a suitable substrate 68. Conductor sheet 58 forms one of the capacitor conductors for the MEMS capacitors in printhead 48 and conductors 66 form the other capacitor conductors. It is expected that, in most applications for printhead 48, conductor sheet 58 will be held at a ground voltage while the voltage of each conductor 66 is varied to flex/vibrate membrane 60 (this electrical configuration is shown in FIGS. 2A and 2B). For this electrical configuration, conductor sheet 58 may be characterized as the capacitor passive conductors and conductors 66 as the capacitor control conductors. Other configurations are possible. For example, rather than a continuous conductive sheet forming each of the passive capacitor conductors, as shown in FIG. 4, individual separate passive conductors could be used. Also, these conductors need not be passive. That is to say, both conductors for each capacitor could be connected to a signal generator or other suitable voltage source to vary the voltage applied to each conductor.

A hole 70 through ink manifold 56, sometimes called a via, exposes conductor sheet 58 for connecting to a ground voltage. Holes 72 through membrane structure 52, also sometimes called vias, expose conductors 66 for connecting to a signal generator. In the embodiment shown, three channels 74 are formed in ink manifold 56. An ink ejection orifice 76 (also called a nozzle) in orifice plate 54 is located at the forward end of each ink channel 74. Orifice plate 58 may be recessed, as shown, to add depth to each ink channel 74. Similarly, the end of each ink channel 74 may be recessed, as shown, to add depth to each orifice 76. As an alternative to the so-called "edge shooter" described above, a so-called "face shooter" could be used in which the ink ejection orifices 76 are formed in the face of orifice plate 54, as indicated by the phantom line orifices 76' in FIG. 4.

FIGS. 5A-16A are crosswise section views and FIGS. 5B-16B are lengthwise section views illustrating one embodiment of a process for fabricating an electrostatic printhead, such as printhead 48 shown in FIG. 4. FIGS. 5A-8A and 5B-8B show a sequence of steps for making a conductor structure 50. FIGS. 9A-12A and 9B-12B show a sequence of steps for partially making a membrane structure 52. FIGS. 13A-16A and 13B-16B show a sequence of steps for assembling the two structures 50 and 52, completing membrane structure 52 and adding an orifice plate 54. Although the formation of the components of only a single printhead 48 are shown, the components of many such printheads may be formed simultaneously on a single wafer or continuous sheets of substrate materials, and the individual printheads subsequently cut or otherwise singulated from the wafer or sheets.

Figure 5A:
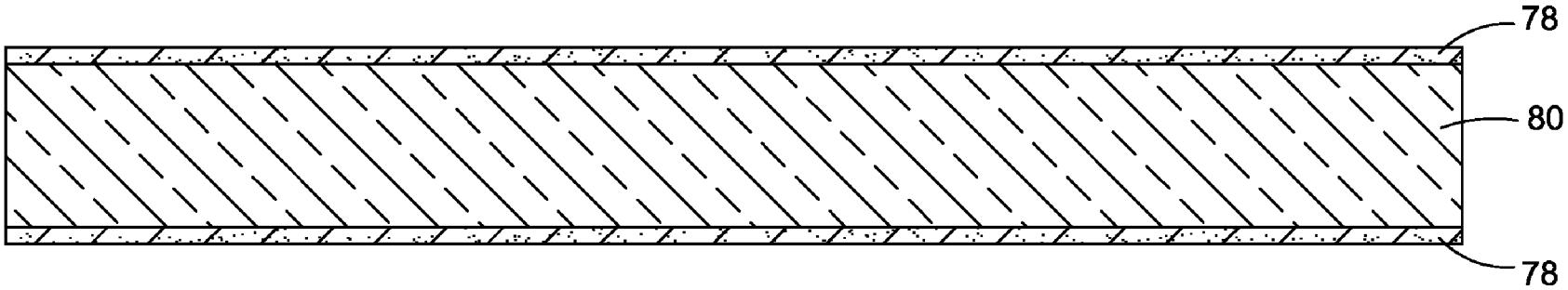
Figure 5B:
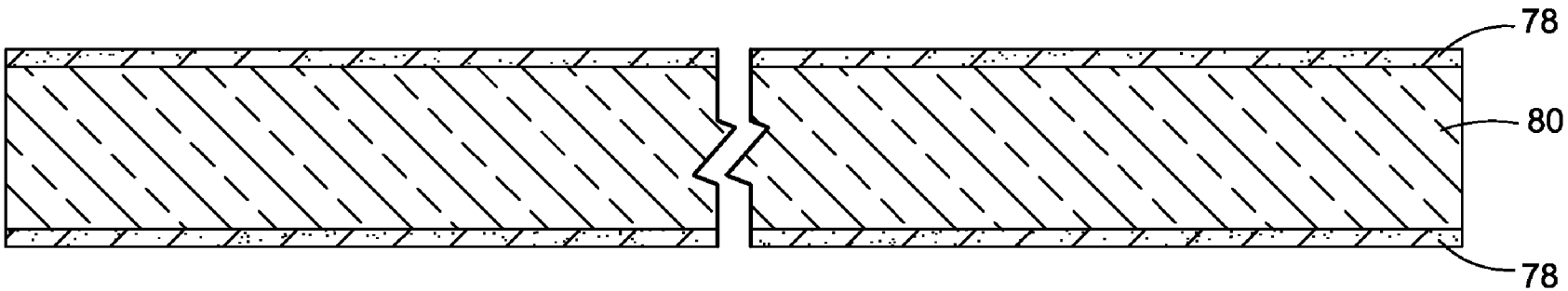
Figure 6A:
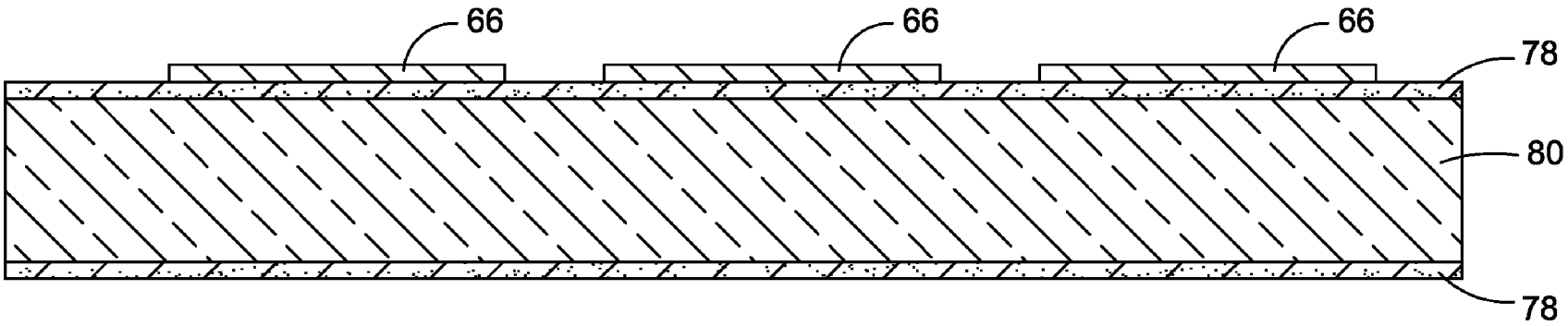
Figure 6B:
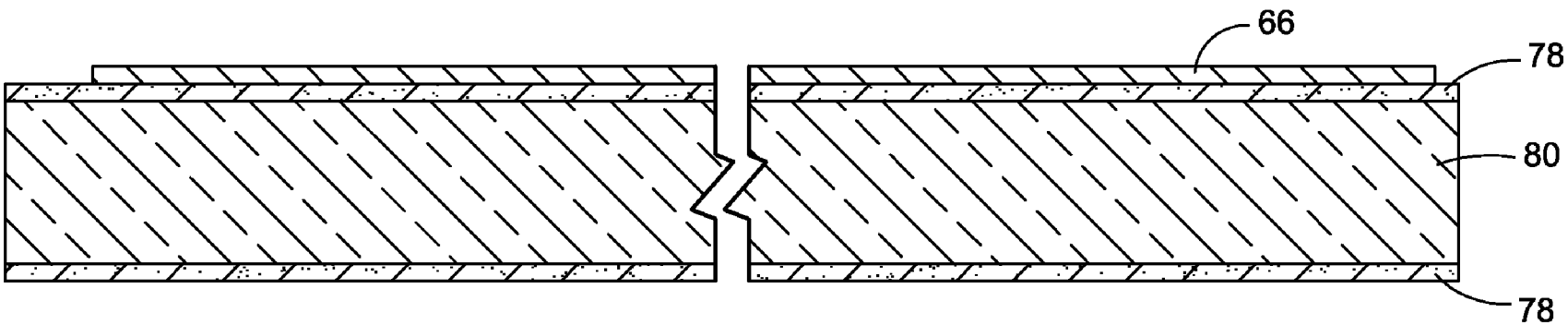

Referring first to FIGS. 5A and 5B, a thin insulating layer 78 is formed on both sides of a substrate 80 by, for example, depositing or growing an oxide on the surfaces of substrate 80. Although substrate 80 may be a silicon wafer, as in conventional electrostatic printhead fabrication, the following fabrication steps do not require a silicon wafer. Consequently, substrate 80 may be, for example, a glass wafer or continuous glass sheet. Glass and other suitable non-silicon materials may often be a preferred substrate material to reduce cost and to improve scalability—wafer processing is limited to modular/batch processes, continuous sheet processing is not. Referring to FIGS. 6A and 6B, a layer of aluminum copper (AlCu) or another suitable conductive material is deposited or otherwise formed on insulating layer 78 on one side of substrate 80. The conductive layer is selectively removed to form control conductors 66 by, for example, patterning and etching the conductive layer. An oxide or other such insulating layer 78 that is selectively etchable with respect to the conductive layer is desirable because it will act as an etch stop to this conductor etch.

The formation of integrated circuits often includes photolithographic masking and etching. This process consists of creating a photolithographic mask containing the pattern of the component to be formed, coating the structure with a light-sensitive material called photoresist, exposing the photoresist coated wafer to ultra-violet light through the mask to soften or harden parts of the photoresist, depending on whether positive or negative photoresist is used, removing the softened parts of the photoresist, etching to remove the materials left unprotected by the photoresist and stripping the remaining photoresist. This photolithographic masking and etching process is referred to herein as "patterning and etching." Although it is expected that the selective removal of materials will typically be achieved by patterning and etching, other selective removal processes could be used. Hence, the reference to patterning and etching in the example fabrication process described and shown should not be construed to limit the processes that may be used for the selective removal of material in the claims that follow this description.

Figure 7A:
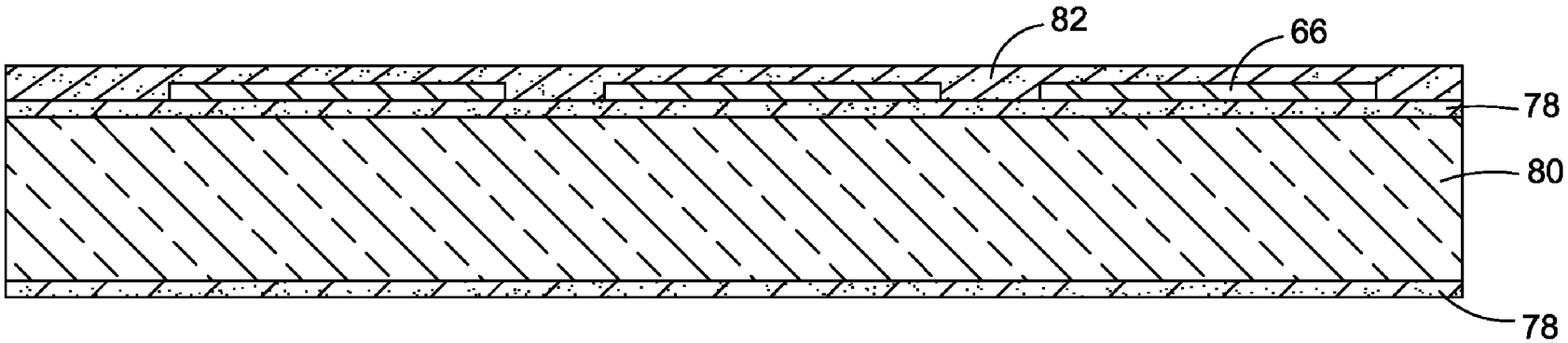
Figure 7B:
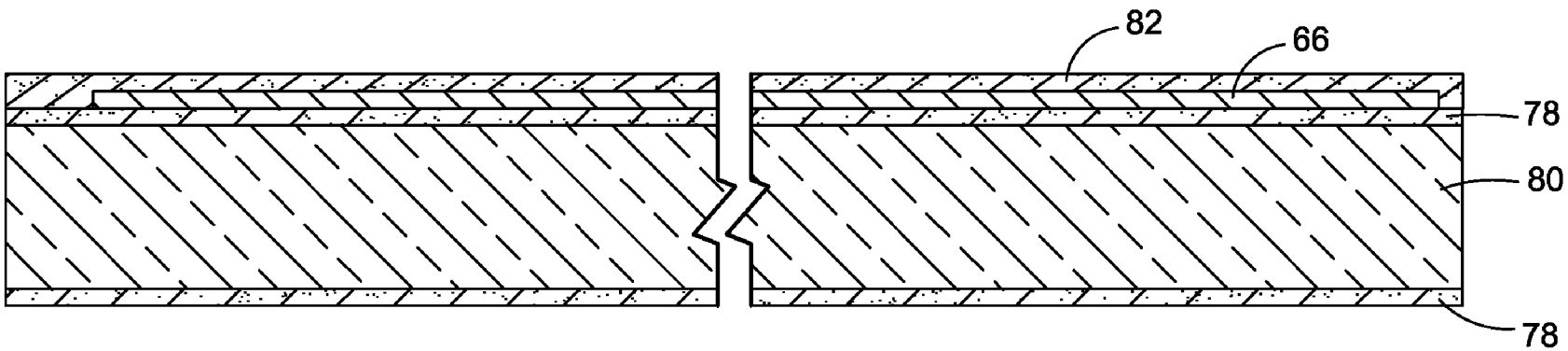
Figure 8A:
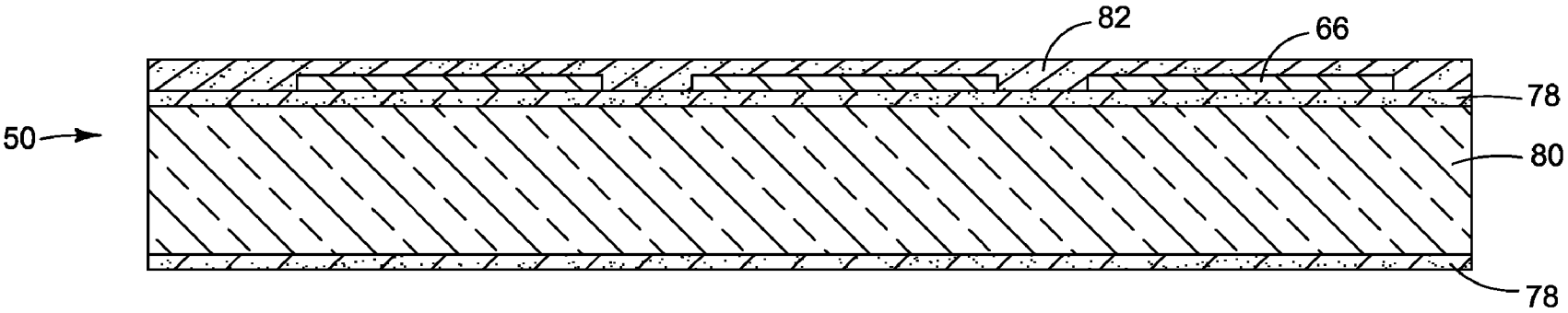
Figure 8B:
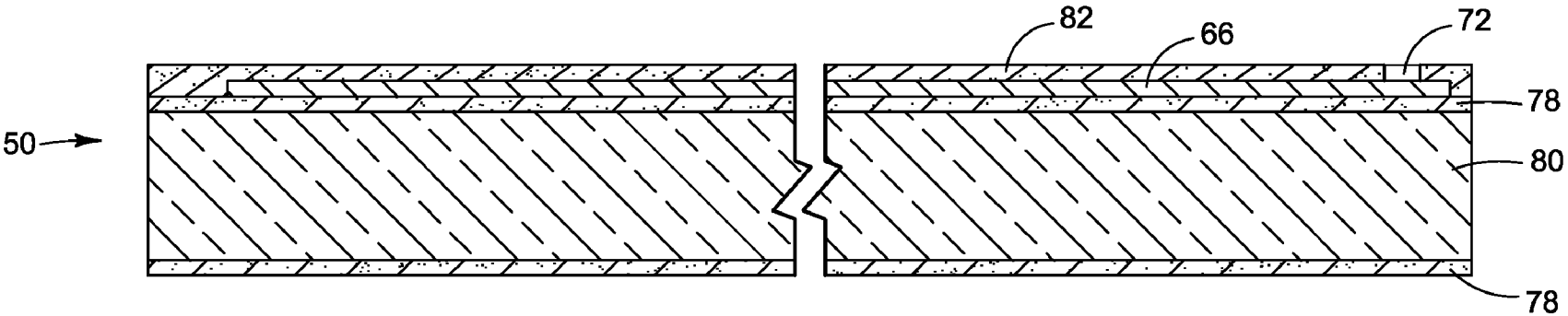

Referring to FIGS. 7A and 7B, a thin insulating layer 82 is formed on conductors 66. Although it is expected that insulating layer 82 will often be formed by depositing silicon dioxide using a tetraethylorthosilicate low temperature chemical vapor deposition (TEOS) process, other suitable materials and processes could also be used. Insulating layer 82 is planarized by, for example, chemical-mechanical polishing to provide a flat, smooth surface for bonding the conductor structure 50 to the membrane structure 52. Insulating layer 82 is patterned and etched as shown in FIG. 8B to expose conductors 66 at contact openings 72 and complete conductor structure 50.

Figure 9A:
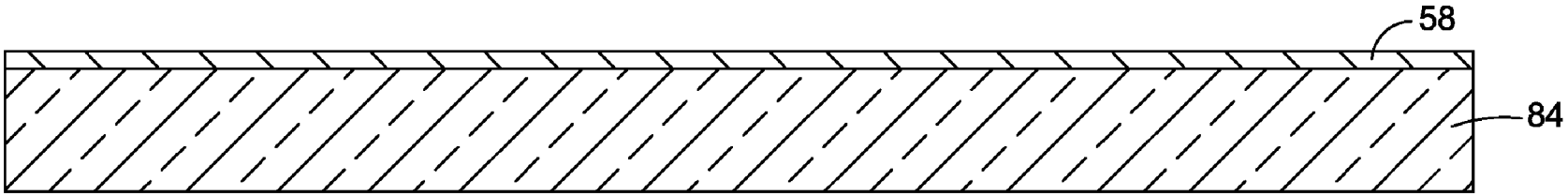
Figure 9B:
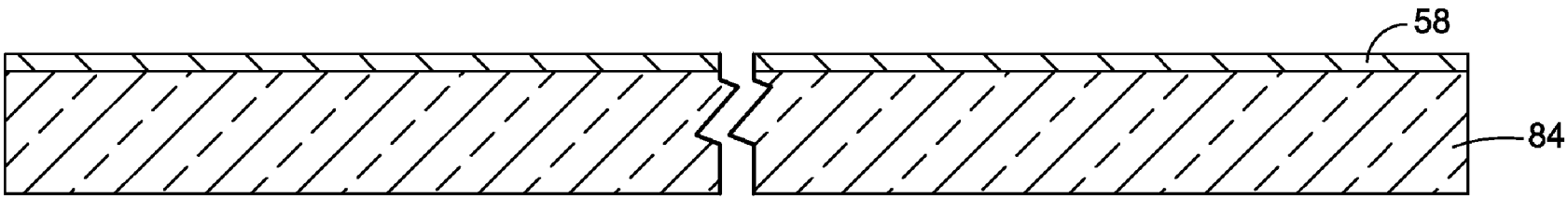
Figure 10A:
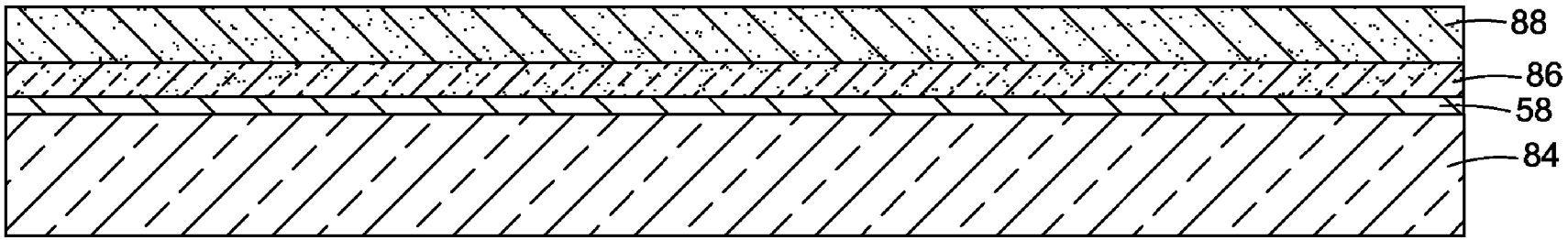
Figure 10B:
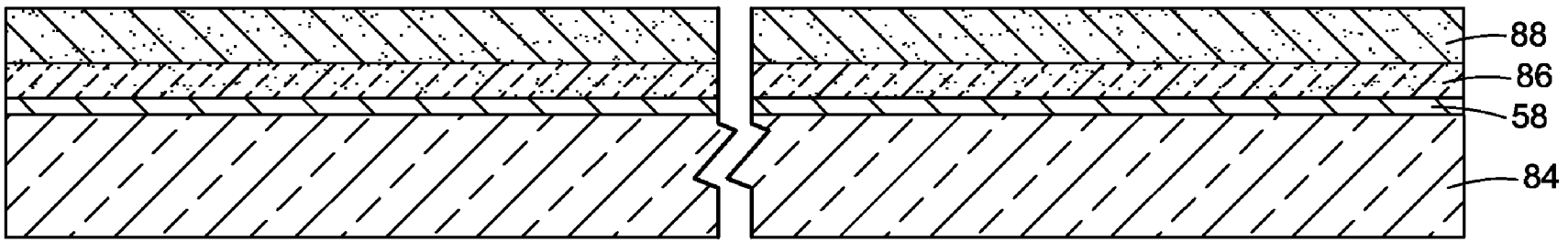
Figure 11A:
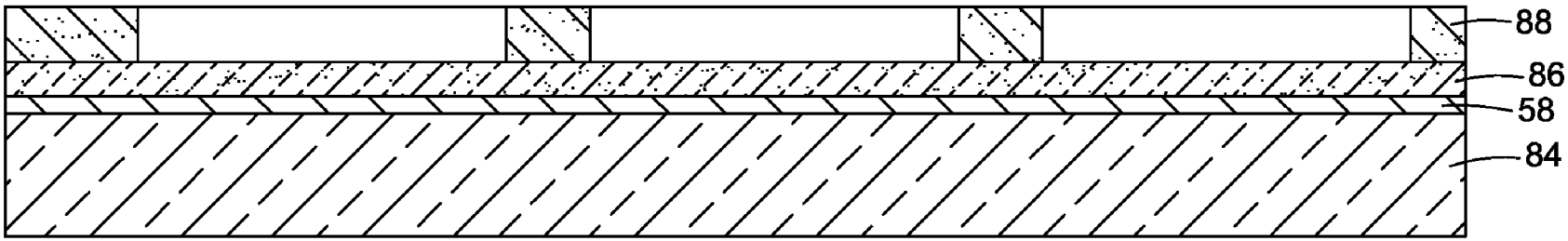
Figure 11B:
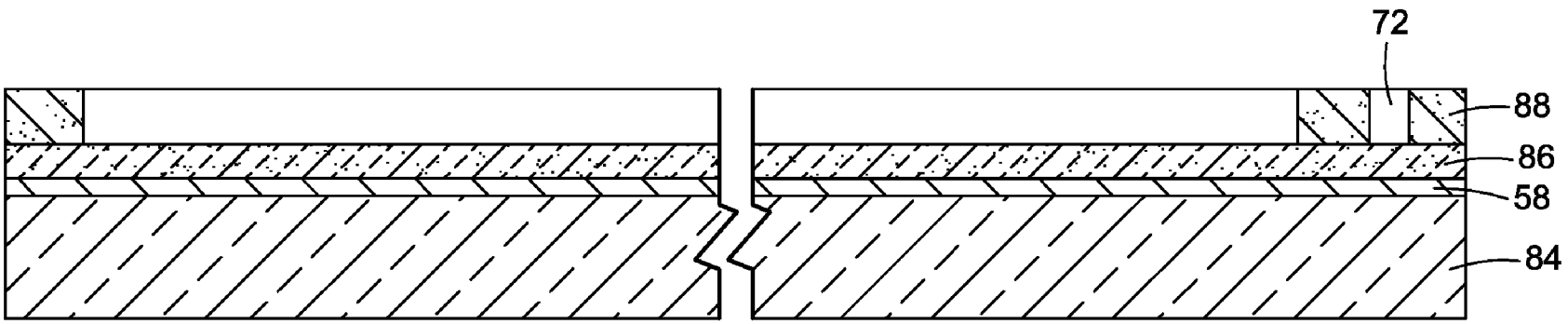

Referring now to FIGS. 9A and 9B, a layer of tantalum or another suitable conductive material is deposited or otherwise formed on one side of a substrate 84 to form a conductive sheet 58. Again, although substrate 84 may be a silicon wafer, as in conventional electrostatic printhead fabrication, the following fabrication steps do not require a silicon wafer. Consequently, substrate 84 may be, for example, a glass or other non-silicon wafer or sheet. If a conductive substrate 84 is used, stainless steel for example, then an insulating layer is first formed on the substrate 84 before depositing conductive sheet 58. Referring to FIGS. 10A and 10B, an etch stop 86 is formed on conductor sheet 58 and a spacer 88 is formed on etch stop 86. Referring to FIGS. 11A and 11B, spacer 88 is patterned and etched to establish the electrostatic/capacitative gaps 90 (FIGS. 13A and 13B) between the flexing and non-flexing capacitor conductors 58 and 66 and to expose etch stop 86 at locations of the flexible membranes 60 and contact openings to control conductors 66. In the embodiment shown, membrane 60 comprises a membrane "stack" that includes part of conductor sheet 58 and etch stop 86.

Unlike conventional processes in which the thickness of the conductive membrane is controlled by a dopant implant into a silicon substrate and silicon etching, the thickness of membrane 60 is controlled by the deposition of conductor sheet 58 and etch stop 86. The materials used to form etch stop 86 and spacer 88 are selectively etchable with respect to one another so that etch stop 86 is substantially impervious to the etch process used to remove spacer 88 at the gap locations. In this way, the width of the gap is controlled by the width/thickness of spacer 88. Thus, thickness of the membrane and the width of the gap are controlled by deposition processes, not implants or etch processes. Deposition processes are typically easier to control than implants and etch processes, at least for maintaining the thickness of the deposition versus the depth of the implant or the depth of the etch. Spacer 88 also provides the bonding surface for bonding membrane structure 52 to conductor structure 50. Where a TEOS oxide bonding layer 82 has been formed on the conductor structure 50, a TEOS oxide spacer 88 will provide a good mating bonding surface on membrane conductor structure 52. Ozone oxides or other dielectrics, for example, may also be used to form spacer 88. A nitride etch stop 86 under a TEOS oxide spacer 88, therefore, will provide the desired barrier while etching the oxide spacer 88. A TEOS oxide spacer 88 is also desirable because the TEOS vapor deposition process provides good control for the thickness of spacer 88.

Figure 12A:
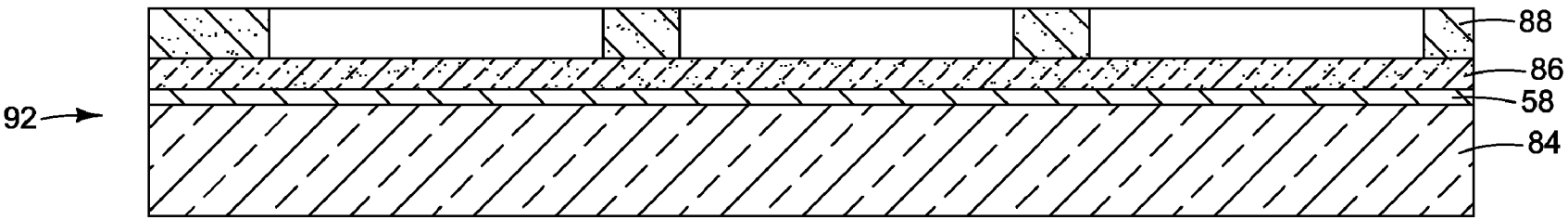
Figure 12B:
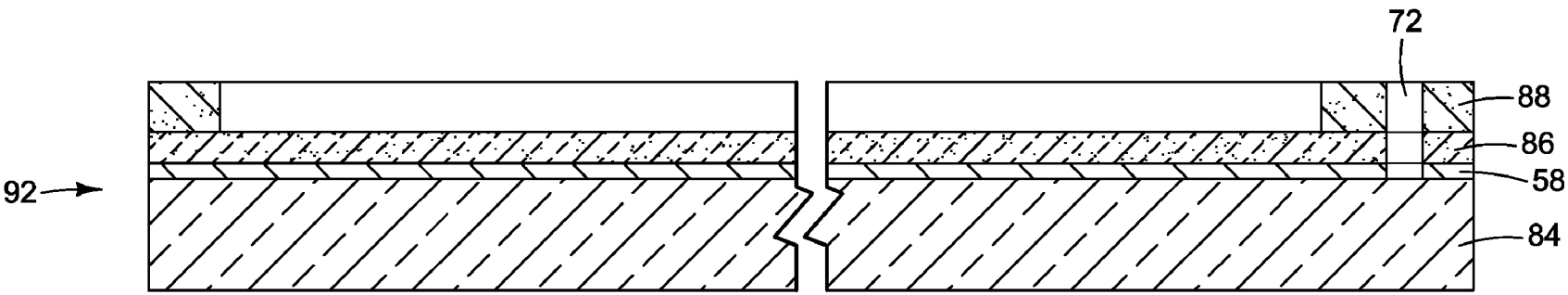
Figure 13A:
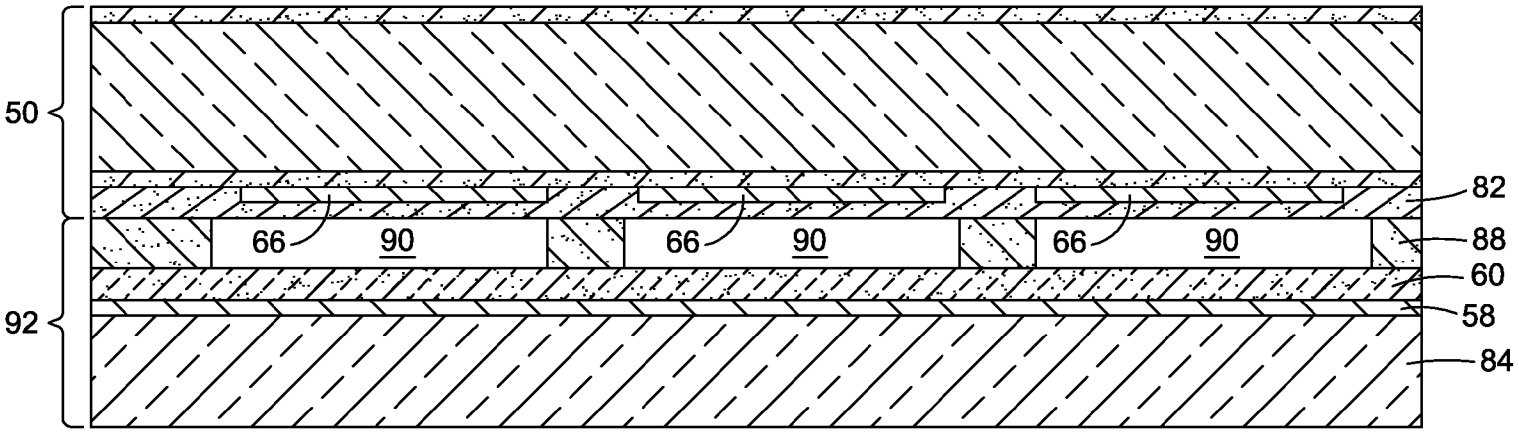
Figure 13B:
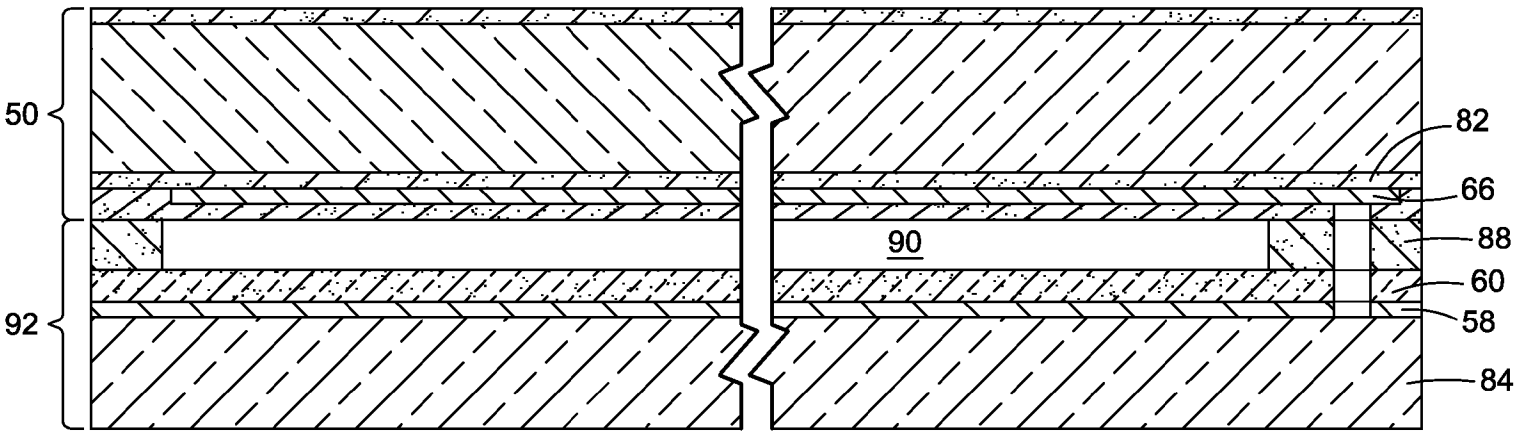
Figure 14A:
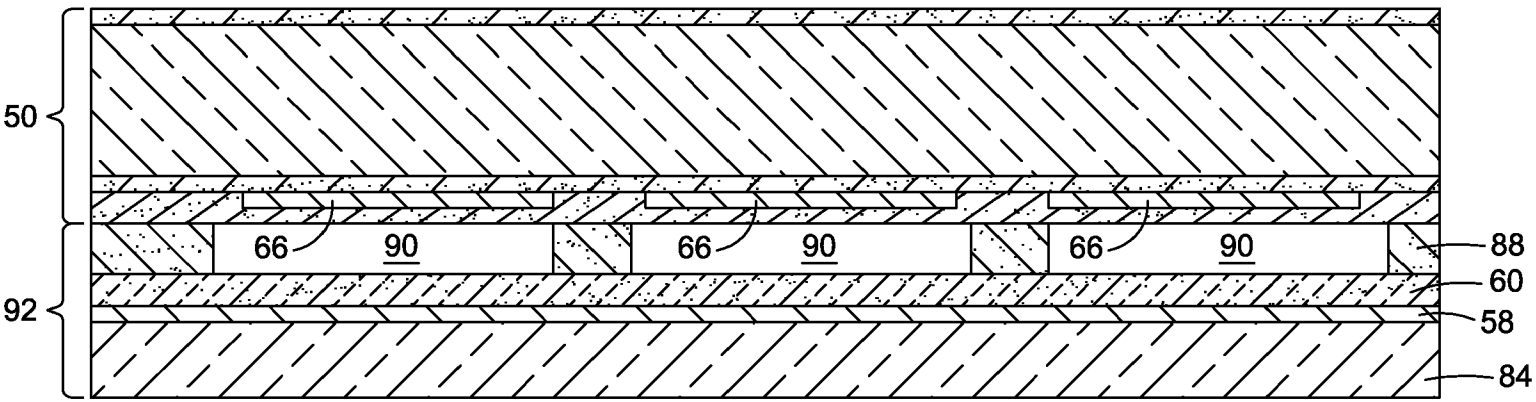
Figure 14B:
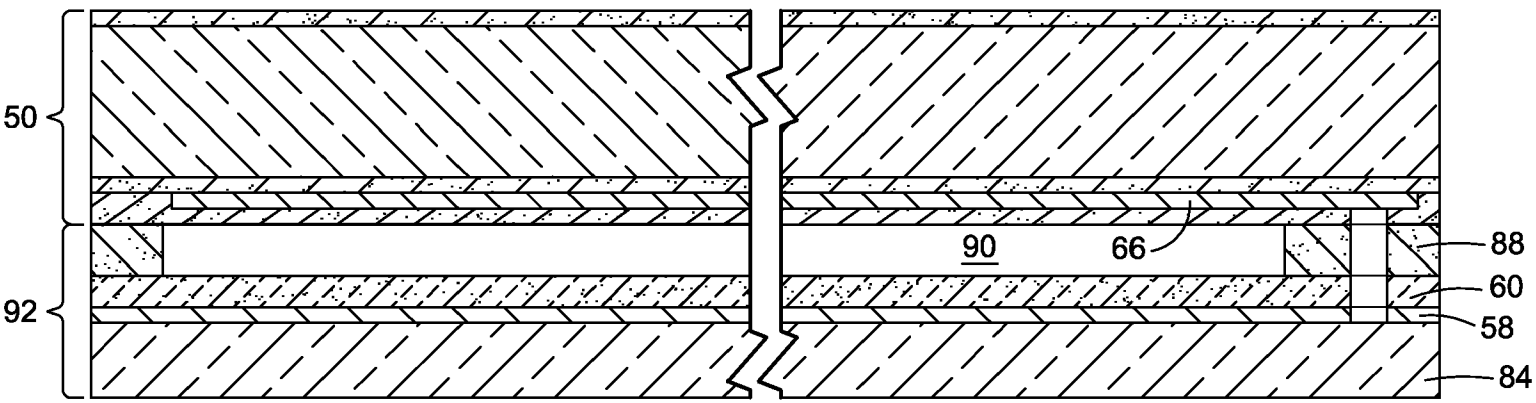
Figure 15A:
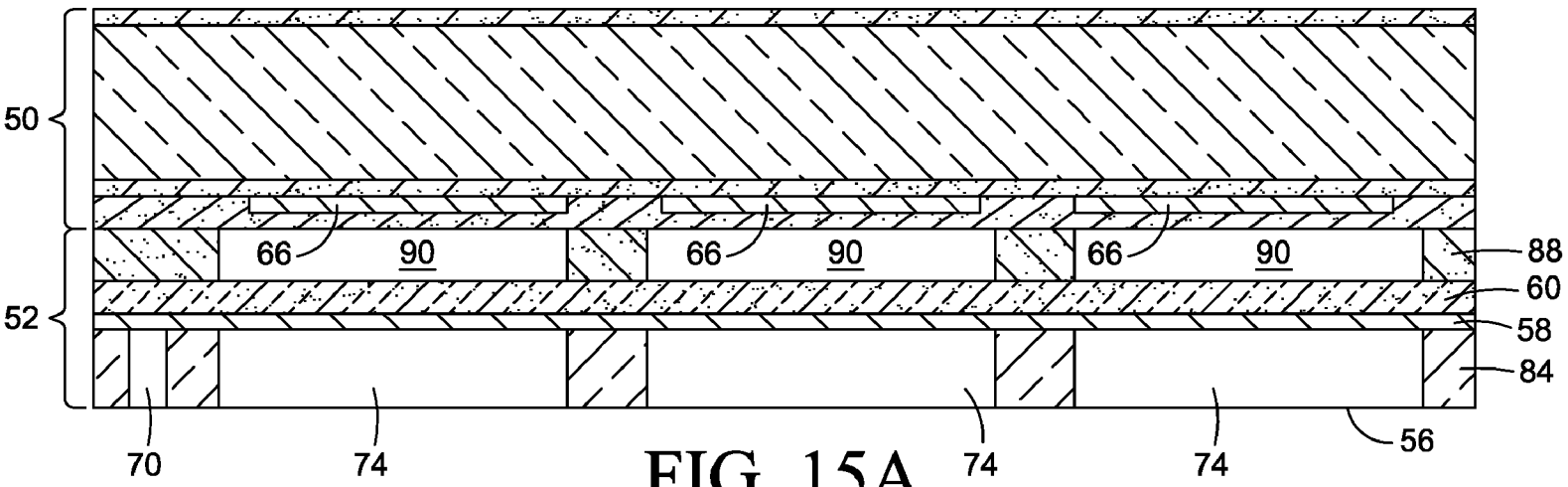
Figure 15B:
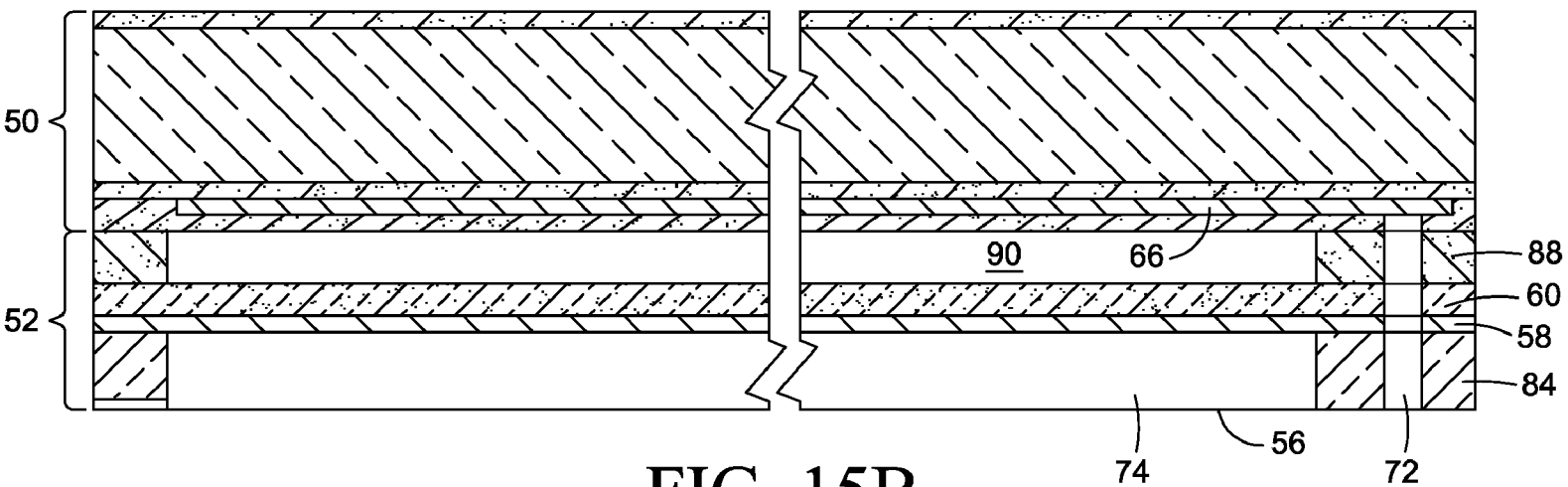
Figure 16A:
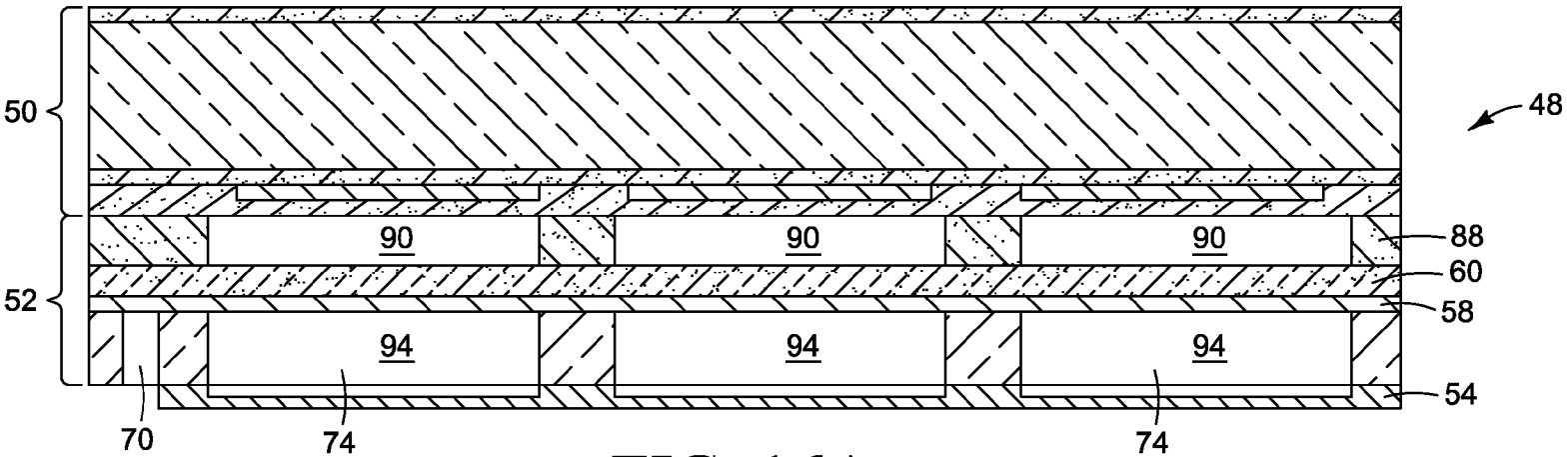
Figure 16B:
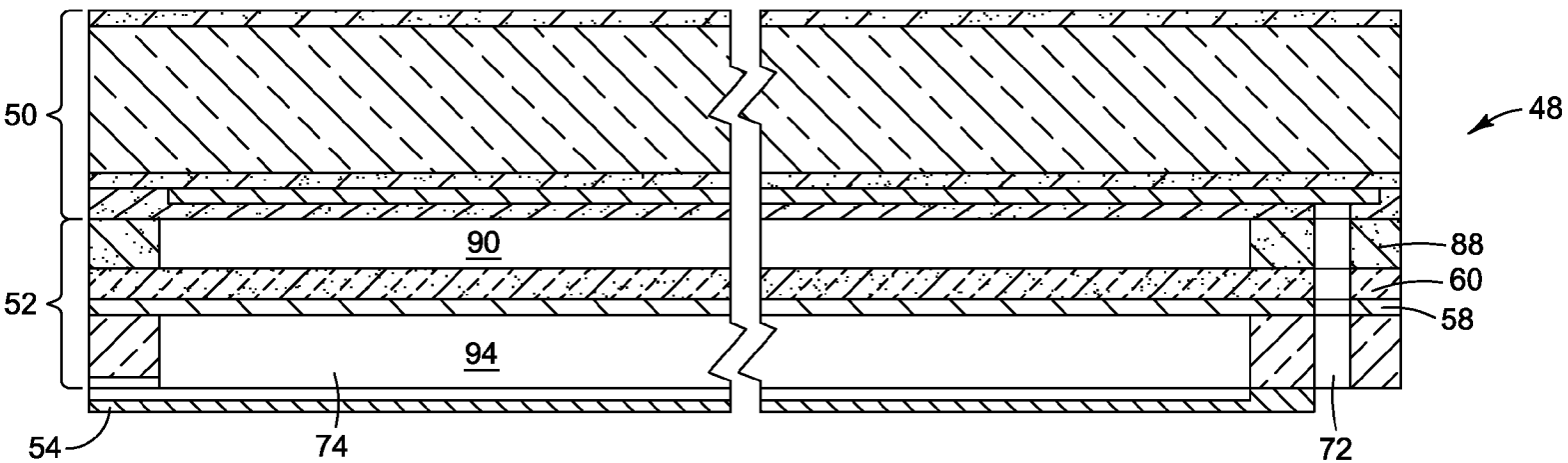

Referring now to FIGS. 12A and 12B, the etch stop 86 and conductive sheet 58 stack is patterned and etched to expose substrate 84 at locations of contact openings 72 to control conductors 66. The resulting in-process membrane structure 92 is then ready for bonding to conductor structure 50. FIGS. 13A-16A and 13B-16B show a sequence of steps for assembling conductor structure 50 and in-process membrane structure 92, completing the membrane structure 52 and adding an orifice plate 54. Referring to FIGS. 13A and 13B, conductor structure 50 and in-process membrane structure 92 are affixed to one another by, for example, plasma bonding TEOS oxide insulating layer 82 of conductor structure 50 to TEOS oxide spacer 88 of in-process membrane structure 92. Any suitable bonding technique may be used including, for example, anodic bonding and diffusion bonding. If needed, the exposed side of membrane structure substrate 84 is ground down to a thickness corresponding to the desired depth for ink channels 74, as shown in FIGS. 14A and 14B. Referring to FIGS. 15A and 15B, substrate 84 is then patterned and etched to form ink channels 74 and ground via 70 and to complete formation of vias 72 to control conductors 66, thus completing the formation of membrane structure 52. Finally, as shown in FIGS. 16A and 16B an orifice plate 54 made for from stainless steel or another suitable material is bonded to the exposed side of membrane structure 52 to complete printhead 48. Orifice plate 54 covers each ink channel 74 to form an ink ejection chamber 94 (but does not cover vias 70 and 72).

The particular dimensions of the various layers and components described above can vary widely depending on the printing application. Nevertheless, for an electrostatic inkjet printhead 48 used in an array 12 (FIG. 1) in a very large format printing application in which the array includes hundreds of printheads, the following is one example of the nominal sizes of some of the components in a printhead 48 printing at a resolution of 600 dpi (dots per inch). Each ink channel 74 and corresponding membrane 60 is about 30 micrometers wide. The electrostatic gap 90 and membrane 60 are each about 200 nanometers thick (conductive sheet 58 is about 100 nanometers thick and a nitride etch stop is about 100 nanometers thick). Ejection chamber 94 in each ink channel 30 is about 200 micrometers deep (including parts formed in both structures 50 and 52).

As used in this document, forming one part "over" another part does not necessarily mean forming one part above the other part. A first part formed over a second part will mean the first part formed above, below and/or to the side of the second part depending on the orientation of the parts. Also, "over" includes forming a first part on a second part or forming the first part above, below or to the side of the second part with one or more other parts in between the first part and the second part.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A fluid drop ejector, comprising:

a first structure including a first conductor formed over a first non-silicon substrate;

a second structure affixed to the first structure, the second structure including:

a fluid channel formed in a second non-silicon substrate, the fluid channel aligned with the first conductor; and a conductive membrane formed over the second non-silicon substrate, the conductive membrane aligned with and forming a wall of the fluid channel at a location between the fluid channel and the first conductor;

a spacer between the first conductor and the conductive membrane, the spacer having openings therein defining a gap between the first conductor and the conductive membrane;

a third structure affixed to the second structure, the third structure covering the fluid channel to form a fluid chamber bounded by a conductive membrane, the second non-silicon substrate and the third structure; and an orifice in the chamber through which fluid may be ejected from the chamber.

2. The ejector of claim 1, wherein:

the first conductor comprises a plurality of first conductors;

the fluid channel comprises a plurality of fluid channels arranged generally parallel to one another, each channel aligned with a corresponding one of the first conductors;

p1 the conductive membrane comprises a plurality of conductive membranes, each conductive membrane aligned with and forming a wall of a corresponding one of the fluid channels at a location between each fluid channel and the corresponding first conductor;

the spacer comprises a spacer between the first conductors and the conductive membranes, the spacer having openings therein defining a gap between each of the first conductors and the corresponding conductive membrane;

the third structure covering the fluid channels to form a plurality of fluid chambers each bounded by a conductive membrane, the second non-silicon substrate and the third structure; and the orifice comprises an orifice in each chamber through which fluid may be ejected from the chamber.

3. The ejector of claim 2, further comprising a voltage source operatively connected to each of the first conductors for selectively applying a voltage between each of the first conductors and each of the conductive membranes.

4. The ejector of claim 2, wherein the orifices are formed in the third structure or the orifices are formed partially in the third structure and partially in the second structure.

5. The ejector of claim 2, wherein:

the first structure further includes an insulator covering the first conductors;

the spacer comprises an insulating spacer formed over the second substrate as part of the second structure; and the insulator on the first structure is bonded to the spacer on the second structure to affix the first structure to the second structure.

6. The ejector of claim 2, wherein the second structure includes a conductive sheet formed over the second substrate, each conductive membrane being defined by those portions of the conductive sheet spanning an opening in the spacer.

7. The ejector of claim 6, wherein the second structure further includes a layer of insulating material formed over the second substrate covering the conductive sheet, each conductive membrane being defined by those portions of the conductive sheet and the insulating material spanning an opening in the spacer.

8. The ejector of claim 6, wherein the second structure further includes an etch stop formed over the second substrate covering the conductive sheet, each conductive membrane being defined by those portions of the conductive sheet and the etch stop spanning an opening in the spacer.

9. An electrostatic actuator, comprising:

a MEMS capacitor in which a conductor is spaced apart across a gap from a conductive membrane in a non-silicon structure; and a drive circuit for selectively charging and discharging the capacitor to flex the conductive membrane.

10. The actuator of claim 9, wherein the MEMS capacitor comprises a plurality of MEMS capacitors in which each of a plurality of distinct conductors are spaced apart across a gap from a corresponding one of a plurality of conductive membranes in a non-silicon structure; and the drive circuit comprises a drive circuit for selectively charging and discharging the capacitors to flex the conductive membranes.

11. The actuator of claim 10, further comprising:

a spacer between the first conductors and the conductive membranes, the spacer having openings therein defining the gap between each of the first conductors and the corresponding conductive membrane;

a conductive sheet; and an etch stop, each conductive membrane being defined by those portions of the conductive sheet and the etch stop spanning an opening in the spacer.

12. The actuator of claim 10, further comprising a plurality of chambers in the non-silicon structure for chambering a fluid, each chamber having an orifice therein through which fluid may be ejected from the chamber and each chamber having a wall comprising a conductive membrane.

13. An electrostatic actuator, comprising:

a structure having plurality of MEMS capacitors in which each of a plurality of distinct first conductors are spaced apart across a gap from a corresponding one of a plurality of conductive membranes, the structure including:

a spacer between the first conductors and the conductive membranes, the spacer having openings therein defining the gap between each of the first conductors and the corresponding conductive membrane;

a conductive sheet; and an etch stop, each conductive membrane being defined by those portions of the conductive sheet and the etch stop spanning an opening in the spacer; and a drive circuit for selectively charging and discharging the capacitors to flex the conductive membranes.

14. The actuator of claim 13, wherein the MEMS capacitors are formed on a non-silicon substrate.

15. The actuator of claim 13, wherein the non-silicon substrate comprises a first non-silicon substrate supporting the first conductors and a second non-silicon substrate supporting the conductive membranes.

16. The actuator of claim 13, further comprising a plurality of chambers in the structure for chambering a fluid, each chamber having an orifice therein through which fluid may be ejected from the chamber and each chamber having a wall comprising a conductive membrane.

* * * * *

UNITED STATES PATENT AND TRADEMARK OFFICE

CERTIFICATE OF CORRECTION

PATENT NO. : 7,677,706 B2
APPLICATION NO. : 11/839954
DATED : March 16, 2010
INVENTOR(S) : George Z. Radominski et al.

It is certified that error appears in the above-identified patent and that said Letters Patent is hereby corrected as shown below:

In column 6, line 61, in Claim 2, before "the" delete "p1".

Signed and Sealed this

Twentieth Day of July, 2010

David J. Kappos

David J. Kappos
*Director of the United States Patent and Trademark Office*